US007202006B2

(12) United States Patent
Chopra et al.

(10) Patent No.: US 7,202,006 B2
(45) Date of Patent: Apr. 10, 2007

(54) PROTECTIVE LAYER FOR REIMAGEABLE MEDIUM

(75) Inventors: Naveen Chopra, Oakville (CA); Gabriel Iftime, Mississauga (CA); Peter M. Kazmaier, Mississauga (CA)

(73) Assignee: Xerox Corporation, Stamford, CT (US)

( * ) Notice: Subject to any disclaimer, the term of this patent is extended or adjusted under 35 U.S.C. 154(b) by 116 days.

(21) Appl. No.: 11/156,437

(22) Filed: Jun. 20, 2005

(65) Prior Publication Data

US 2007/0003847 A1 Jan. 4, 2007

(51) Int. Cl.

| | |
|---|---|
| ***G03C 1/675*** | (2006.01) |
| ***G03C 1/73*** | (2006.01) |
| ***G03C 1/815*** | (2006.01) |
| ***G03C 5/22*** | (2006.01) |
| ***G03C 5/16*** | (2006.01) |

(52) U.S. Cl. ..... 430/138; 430/333; 430/335; 430/338; 430/339; 430/342; 430/962

(58) Field of Classification Search ..... 430/333, 430/335, 338, 339, 342, 138, 962
See application file for complete search history.

(56) References Cited

U.S. PATENT DOCUMENTS

| | | | | |
|---|---|---|---|---|
| 3,697,437 | A | 10/1972 | Fogle et al. | |
| 4,808,408 | A | 2/1989 | Baker et al. | |
| 5,540,927 | A | 7/1996 | Jason et al. | |
| 6,488,870 | B1 | 12/2002 | Chopra et al. | |
| 2005/0244742 | A1* | 11/2005 | Iftime et al. | 430/270.1 |
| 2006/0269878 | A1* | 11/2006 | Chopra et al. | 430/333 |

* cited by examiner

*Primary Examiner*—Richard L. Schilling
(74) *Attorney, Agent, or Firm*—Eugene O. Palazzo; Fay Sharpe LLP

(57) ABSTRACT

A reimageable recording medium includes a substrate, a display layer, and a protective layer. The protective layer comprises a microencapsulated diarylethene material that is capable of switching between a UV absorbing and UV transparent state. During an imaging process, the protective layer is switched from a UV absorbing state to a UV transparent state to allow UV light of a sufficient wavelength to convert a photochromic material of the display layer to a colored state to form an image. The protective material is then switched back to a UV absorbing state to prevent the UV light component from a reading source to convert unimaged areas of the display layer to change color, which would reduce the contrast and resolution of the imaged medium.

30 Claims, 1 Drawing Sheet

PROTECTIVE LAYER FOR REIMAGEABLE MEDIUM

BACKGROUND

The present disclosure relates, in various exemplary embodiments, to reimageable recording medium comprising a protective layer. More specifically, the present disclosure relates to a reimageable recording medium comprising a protective layer that is capable of exhibiting and switching between i) a UV transparent state to allow for forming an image on an underlying display layer, and ii) a UV absorbing state to protect unimaged areas of the recording medium from exposure to incident UV light under viewing conditions that may discolor the unimaged areas.

One method for providing a reimageable recording medium is to provide a recording medium coated with a photochromic material. Photochromic materials change from a colorless to a colored state when exposed to ultraviolet light. Co-pending application Ser. Nos. 10/835,518 and 10/834,722 (the contents of which are totally incorporated herein by reference) are respectively directed to a reimageable recording medium comprising a photochromic material and a method for forming an image using such a reimageable recording medium. Some examples of known photochromic materials include spiropyrans and spiroxazines. Upon exposure to ultraviolet light, the closed ring structures, which exists in a colorless state, open and exhibit a colored state. The formulas below depict the closed and open states of a spiropyran and spiroxazine, respectively.

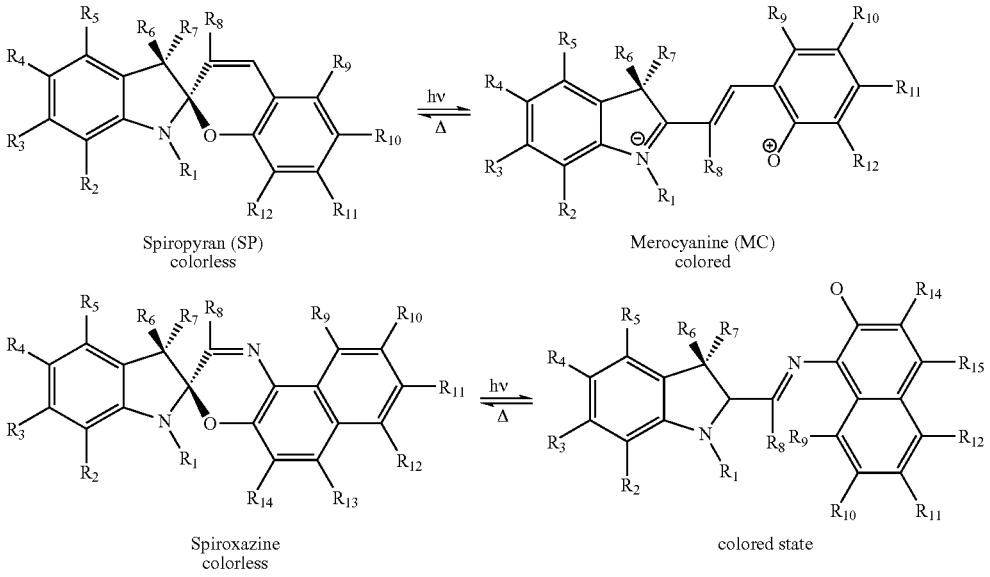

Readable or viewable images are formed by exposing selected areas of a medium comprising a photochromic material to UV light, typically having a wavelength of 365 nm, to cause the photochromic material to change from the colorless state to the colored state. The printed information or image is viewable for a limited period of time, and the image self-erases as the photochromic material changes back to the colorless form. This leaves a blank medium (e.g., a document) that is ready to be reimaged as desired with new information.

The visual quality, and hence, readability of the document depends on the resolution of the imaged areas. The resolution depends on the contrast ratio between the colored (imaged) areas of the document and the colorless (unimaged) areas of the document. The unimaged areas are typically white (depending on the type of substrate used). Unimaged areas, however, are sensitive to the UV component of the light used to read the document (e.g., UV-VIS, room-light such as from a light bulb, sun-light, and the like). Therefore, unimaged areas become slightly colored over time and reduce the contrast between the white and colored states and therefore also reduces the readability of the document.

Attempts to solve this problem have been made by creating a band-pass window for the incident light capable of isomerising (i.e., inducing coloration) the material centered around 365 nm. The stability of such transient documents has been significantly improved when compared to unprotected documents. The unimaged areas, however, are still sensitive to the UV component of visible light centered at 365 nm.

Co-pending application U.S. patent application Ser. No. 11/139,890, now allowed, the entire disclosure of which is incorporated herein by reference, discloses photochromic protective layers for a selectively imageable member. The protective layers comprise a material that is capable of switching between a UV absorbing state and a UV transparent state. The UV transparent state is obtained by illumination with high intensity UV light. In this state, UV light is able to be transmitted through the protective layer to an underlying imaging layer comprising a photochromic material that is converted to its colored state to form an image. After a period of time, the protective material reverts back to the UV absorbing state and prevents incident UV light from coloring the unimaged areas.

There is still a need to provide protective materials that are sensitive to longer wavelengths (i.e., 400 nm). Secondly, there is also a need to provide these materials in solution form that allows the materials to switch between the desired UV transparent and UV absorbing states. Further, and separate and apart from the above, there is a need to provide protecting materials in a microencapsulated form that can be applied as a coating on top of the imaging material.

CROSS REFERENCE TO RELATED PATENTS AND APPLICATIONS

U.S. patent application Ser. No. 11/139,890, now allowed, the entire disclosure of which is incorporated herein by reference, discloses photochromic protective layers for a selectively imageable member.

BRIEF DESCRIPTION

The present disclosure relates, in various embodiments thereof, to a reimageable medium comprising a substrate; a display layer comprising a photochromic material that is imageable upon exposure to an imaging light of a first wavelength; and a protective layer comprising a microencapsulated protective material that is switchable between a UV light absorbing state and a UV light transparent state.

The present disclosure also relates, in various embodiments thereof, to a reimageable recording medium comprising a substrate; a display layer comprising a photochromic material that is upon exposure to an imaging light of a first wavelength; and a protective layer comprising a plurality of microcapsules comprising a diarylethene material, the diarylethene material being switchable between a UV absorbing state and a UV transparent state.

Further, the present disclosure relates, in various embodiments thereof, to a method for forming a temporary image comprising providing a reimageable medium comprising a substrate, a display layer comprising a photochromic material, and a protective layer, the protective layer comprising a plurality of microcapsules encapsulating a diarylethene material that is switchable between a UV light absorbing state and a UV light transparent state; exposing selected areas of the medium to light of a first wavelength sufficient for switching the protective layer from a UV light absorbing state to a UV light transparent state; exposing the selected areas of the medium to light of a second wavelength to convert the photochromic material from a colorless state to a colored state, thereby forming a viewable image; and exposing the medium to light of a third wavelength sufficient to switch the protective layer from a UV transparent state to a UV absorbent state.

These and other non-limiting embodiments will be more particularly described with regard to the drawings and detailed description set forth below.

BRIEF DESCRIPTION OF THE DRAWINGS

The following is a brief description of the drawings, which are for the purpose of illustrating the embodiments and not for the purpose of limiting the same.

DETAILED DESCRIPTION

Figure 1:
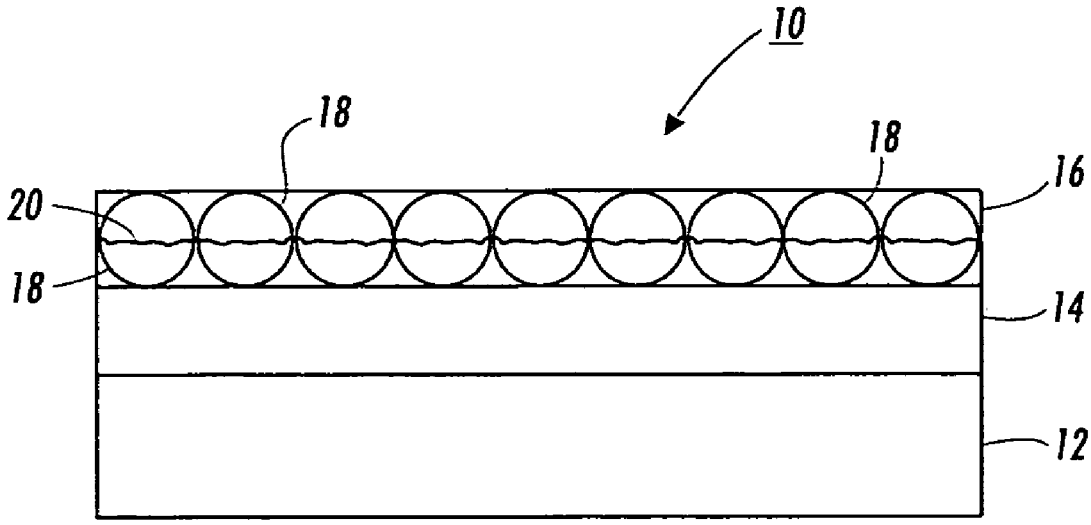
FIG. 1 is a schematic cross-sectional view of a reimageable recording medium having a protective layer in accordance with the present disclosure.

The present disclosure relates to a reimageable medium and method for forming an image on such a medium. A reimageable medium comprises a protective layer that is capable of exhibiting and switching between a UV transparent state and a UV absorbing state to allow the forming of an image or an underlying display layer under certain conditions (UV transparent state) and prevent undesirable coloration of unimaged areas under viewing or reading conditions (UV absorbing state).

A more complete understanding of the processes and apparatuses disclosed herein can be obtained by reference to the accompanying drawings. These figures are merely schematic representations based on convenience and the ease of demonstrating the present development, and are, therefore, not intended to indicate relative size and dimensions of the members or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to component of like function.

With reference to FIG. 1, one possible embodiment of a reimageable recording medium is shown. Reimageable recording medium 10 comprises a substrate 12, a display layer 14, and a protective layer 16. Display layer 14 generally comprises a material, such as a photochromic material, that is capable of forming a viewable image upon exposure to light of an appropriate wavelength. Protective layer 16 comprises a protective material 20 encapsulated in microcapsules 18. The protective material 20 is capable of switching between a UV absorbing state to a UV transparent state.

In embodiments, the substrate is made of a flexible material. The substrate can be transparent or opaque. The substrate may be composed of any suitable material such as wood, plastics, paper, fabrics, textile products, polymeric films, inorganic substrates such as metals, and the like. The plastic may be for example a plastic film, such as polyethylene film, polyethylene terephthalate, polyethylene naphthalene, polystyrene, polycarbonate, polyethersulfone, and the like. The paper may be for example plain papers such as XEROX® 4024 papers, ruled notebook paper, bond paper, silica coated papers such as Sharp Company silica coated paper, Jujo paper, and the like. The substrate may be a single layer or multi-layer where each layer is the same or different material. The substrate may have a thickness as selected for a particular purpose or intended use. In embodiments, the substrate has a thickness in the range of, for example, from about 0.3 mm to about 5 mm.

In embodiments, the substrate (and reimageable medium) has any number of sides such as two (e.g., a sheet of paper), three, four or more sides (e.g., a cube). When one is trying to determine the number of sides of the substrate/medium, it is helpful to consider the intended use of the medium. For example, where the substrate/medium has the configuration of a folder (of the kind for holding loose papers) but the folder is laid relatively flat when viewing the temporary image that stretches across the entire viewing surface, the substrate/medium can be thought of as having two sides (front and back sides). In embodiments, the side can have a curved shape. It is understood that the number of reimageable sides of the medium may be the same as or fewer than the number of sides of the substrate. For example, where the substrate is a sheet of paper and the photochromic material is present only on one side of the paper, then the reimageable medium has only one reimageable side even though the substrate is two-sided.

The color of the substrate may be selected as desired for a particular purpose or intended use. In embodiments, the substrate has a light color, such as, for example, a white color, on any number of sides such as on one side or on two sides or on all sides.

The substrate medium may be rigid or flexible. In fact, the substrate may have any suitable rigidity or flexibility depending on the intended use for the reimageable medium. In embodiments, the substrate is capable of undergoing a number of cycles of being rolled-up/folded and then unrolled/unfolded. The substrate medium has any suitable size such as the dimensions of a business card, the dimensions of a sheet of paper (e.g., A4 and letter sized), or larger, and the like. The substrate medium may have any suitable shape such as planar (e.g., a sheet) or non-planar (e.g., cube, scroll, and a curved shape). In embodiments, a plurality of reimageable mediums can also be combined to form a larger reimageable surface analogous to a giant display screen composed of a number of smaller display screens.

The display layer may include any material suitable for creating or producing a viewable, erasable, image. In embodiments, the display layer comprises a photochromic material that is capable of switching from a colorless to a colored state upon exposure to a particular wavelength of light. The photochromic material is not limited and may be selected as desired for a particular purpose or intended use. Any suitable photochromic material may be used, especially an organic photochromic material. Examples of suitable photochromic materials include compounds that undergo heterocyclic cleavage, such as spiropyrans and related compounds; compounds that undergo homocyclic cleavage such as hydrazine and aryl disulfide compounds; compounds that undergo cis-trans isomerization such as azo compounds, stilbene compounds and the like; compounds that undergo proton or group transfer phototautomerism such as photochromic quinines; compounds that undergo photochromism via electron transfer such as viologens and the like; and others. Examples of suitable photochromic materials include, but are not limited to, spiropyrans, spiroxazines, spirothiopyrans, stilbenes, aromatic azo compounds, benzo and naphthopyrans (chromenes), bis-imidazoles, spirohydroindolizines and related systems such as tetrahydroindolizines and hexahydroindolizines, photochromic quinines, perimidinespirocyclohexadienones, photochromic viologens, fulgides and fulgimides, diarylethenes, triarylmethanes, anils and related compounds, and the like. Non-limiting examples of suitable photochromic materials are described in detail in co-pending application Ser. Nos. 10/835,518 and 10/834,722, the entire disclosures of which are incorporated herein by reference.

Suitable examples of the photochromic material include spiropyrans compounds and analogue compounds of the general formulas (the closed form may be colorless/weakly colored; the open form may be differently colored):

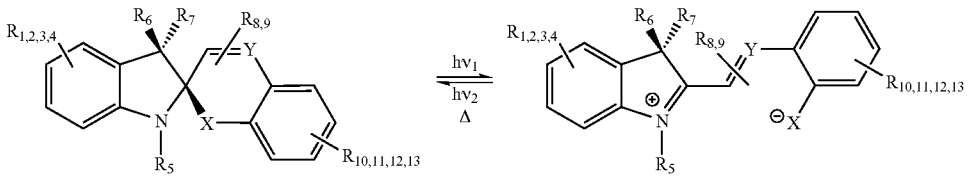

Closed form
(Spiropyran when X = O and Y = CH)

Open form
(Merocyanine when X = O and Y = CH)

wherein $R_1$, $R_2$, $R_3$, $R_4$, $R_5$, $R_6$, $R_7$, $R_8$, $R_9$, $R_{10}$, $R_{11}$, $R_{12}$ and $R_{13}$ each, independently of the others can be (but are not limited to) hydrogen; alkyl, including cyclic alkyl groups, such as cyclopropyl, cyclohexyl, and the like; unsaturated alkyl groups, such as vinyl ($H_2C{=}CH{-}$), allyl ($H_2C{=}CH{-}CH_2{-}$), propynyl ($HC{\equiv}C{-}CH_2{-}$), and the like, having from 1 to about 50 carbon atoms and, in some embodiments, from 1 to about 30 carbon atoms; aryl having, in embodiments, from about 6 to about 30 carbon atoms and, in other embodiments, from about 6 to about 20 carbon atoms; arylalkyl, having in embodiments from about 7 to about 50 carbon atoms and, in other embodiments, from about 7 to about 30 carbon atoms; silyl groups;, nitro groups; cyano groups; halide atoms; such as fluoride, chloride, bromide, and iodide; amine groups, including primary, secondary, and tertiary amines; hydroxy groups, alkoxy groups having, in embodiments, from 1 to about 50 carbon atoms and, in other embodiments, from 1 to about 30 carbon atoms; aryloxy groups, having, in embodiments, from about 6 to about 30 carbon atoms and, in other embodiments, from about 6 to about 20 carbon atoms; alkylthio groups, having, in embodiments, from 1 to about 50 carbon atoms and, in other embodiments, from 1 to about 30 carbon atoms; arylthio groups, having, in embodiments, from about 6 to about 30 carbon atoms and, in other embodiments, from about 6 to about 20 carbon atoms; aldehyde groups; ketone groups; ester groups; amide groups; carboxylic acid groups; sulfonic acid groups; and the like. The alkyl, aryl, and arylalkyl groups can also be substituted with groups such as, for example, silyl groups; nitro groups; cyano groups; halide atoms, such as fluoride, chloride, bromide, iodide, and amine groups, including primary, secondary, and tertiary amines; hydroxy groups; alkoxy groups having, in embodiments, from 1 to about 20 carbon atoms and, in other embodiments, from 1 to about 10 carbon atoms; aryloxy groups, having, in embodiments, from about 6 to about 20 carbon atoms and, in embodiments, from about 6 to about 10 carbon atoms; alkylthio groups, having, in embodiments, from 1 to about 20 carbon atoms and, in other embodiments, from 1 to about 10 carbon atoms; arylthio groups, having, in embodiments, from about 6 to about 20 carbon atoms and, in other embodiments, from about 6 to about 10 carbon atoms; aldehyde groups; ketone groups; ester groups; amide groups; carboxylic acid groups; sulfonic acid groups, and the like. Further, two or more R groups (that is, $R_1$ through $R_{13}$) can be joined together to form a ring.

X can be Oxygen atom (O) or Sulphur atom (S). Y can be CH group, Nitrogen atom (N) or Phosphorus atom (P). Compounds with X═O and Y═CH, are known as spiropyrans. In this case, the closed form isomer is known as spiropyran compound, while the open form isomer is known as merocyanine compound. Compounds with X═O and Y═N, are known as spiroxazines. Compounds with X═S and Y═CH are known as spirothiopyrans.

Electron donor substituents like for example amino, alkoxy or groups and electron donor substituents like for example nitro or cyan on spiropyran, spirooxazine, and spirothiopyran can be adjusted to affect the color of the open form of the photochromic material, as well as the absorption spectrum of the closed form. Substituents on the central moiety of the spiropyrans, spirooxazines, and spirothiopyrans or on alkyl or aryl groups attached thereto also affect the color of the open form of the photochromic material, although to a lesser degree than substituents on the left ring. Further, substituents can be tuned as to affect the solubility of the compound in various liquids and resins. Substitutents with long chain hydrocarbons, such as those with 16 or 18 carbon atoms, can increase solubility in hydrocarbons. Sulfonate and carboxylate groups, for example, can enhance water solubility.

Examples of suitable spiropyrans, spirooxazines, and spirothiopyrans include, but are not limited to, 1',3'-dihydro-1',3',3'-trimethyl-6-nitrospiro-[2H-1-benzopyran-2,2'-(2H)-indole]; 1',3'-dihydro-1',3',3'-trimethyl-5'-nitrospiro-[2H-1-benzopyran-2,2'-(2H)-indole], 1',3'-dihydro-1',3',3'-trimethyl-6-cyano-spiro-[2H-1-benzopyran-2,2'-(2H)-indole], 1',3'-dihydro-1',3',3'-trimethyl-8-nitrospiro-[2H-1-benzopyran-2,2'-(2H)-indole], 1',3'-dihydro-1',3',3'-trimethyl-6-nitro, 8-methoxy-spiro-[2H-1-benzopyran-2,2'-(2H)-indole], 1',3'-dihydro-1'-decyl-, 3',3'-dimethyl-6-nitrospiro-[2H-1-benzopyran-2,2'-(2H)-indole], 1,3-dihydro-1,3,3-trimethylspiro[2H-indole-2,3'-[3H]naphth[2,1-b]-[1,4]oxazine], 1,3-dihydro-1,3,3-trimethyl-5-nitrospiro[2H-indole-2,3'-[3H]naphth[2,1-b]-[1,4]oxazine], 1,3-dihydro-1,3,3-trimethyl-5,6'-dinitro-spiro[2H-indole-2,3'-[3H]naphth[2,1-b]-[1,4]oxazine], 1,3-dihydro-1,3,3-trimethyl-5-methoxy, 5'-methoxy-spiro[2H-indole-2,3'-[3H]naphth[2,1-b]-[1,4]oxazine], 1,3-dihydro-1-ethyl-3,3-dimethyl-5'-nitrospiro[2H-indole-2,3'-[3H]naphth[2,1-b]-[1,4]oxazine], 1,3',3'-trimethylspiro[2H-1-benzothiopyran-2,2'-indoline].

Examples of stilbenes include, but are not limited to, stilbene (no substituents), 3-methylstilbene, 4-methoxystilbene, 3-methoxystilbene, 4-aminostilbene, 4-fluorostilbene, 3-fluorostilbene, 4-chlorostilbene, 3-chlorostilbene, 4-bromostilbene, 3-bromostilbene, 3-iodostilbene, 4-cyanostilbene, 3-cyanostilbene, 4-acetylstilbene, 4-benzoylstilbene, 4-phenacylstilbene, 4-nitrostilbene, 3-nitrostilbene, 3-nitro-3'-methoxystilbene, 3-nitro-4-dimethylaminostilbene, 4,4'-dinitrostilbene, 4-nitro-4'-methoxystilbene, 4-nitro-3'-methoxystilbene, 4-nitro-4'-aminostilbene, 4-nitro-4'-dimethylaminostilbene, α-methylstilbene, α,α'-dimethylstilbene, α,α'-difluorostilbene, α,α'-dichlorostilbene, 2,4,6-trimethylstilbene, 2,2',4,4',6,6'-hexamethylstilbene, and the like.

Examples of photochromic azo compounds include, but are not limited to, azobenzene, 2-methoxyazobenzene, 2-hydroxyazobenzene, 3-methylazobenzene, 3-nitroazobenzene, 3-methoxyazobenzene, 3-hydroxyazobenzene, 4-iodoazobenzene, 4-methylazobenzene, 4-carbomethoxyazobenzene, 4-acetylazobenzene, 4-carboxyazobenzene, 4-cyanoazobenzene, 4-ethoxyazobenzene, 4-methoxyazobenzene, 4-nitroazobenzene, 4-acetamidoazobenzene, 4-dimethylaminoazobenzene, 4-aminoazobenzene, 4-trimethylammonium azobenzene, 4-dimethylamino-4'-phenylazobenzene, 4-dimethylamino-4'-hydroxyazobenzene, 4,4'-bis-(dimethylamino)azobenzene, 4-dimethylamino-4'-p-aminophenylazobenzene, 4-dimethylamino-4'-p-acetamidophenylazobenzene, 4-dimethylamino-4'-p-aminobenzylazobenzene, 4-dimethylamino-4'-mercuric acetate azobenzene, 4-hydroxyazobenzene, 2-methyl-4-hydroxyazobenzene, 4-hydroxy-4'-methylazobenzene, 2,6-dimethyl-4-hydroxyazobenzene, 2,2'4',6,6'-pentamethyl-4-hydroxyazobenzene, 2,6-dimethyl-2',4',6'-trichloro-4-hydroxyazobenzene, 4-hydroxy-4'-chloroazobenzene, 2,2',4',6'-tetrachloro-4-hydroxyazobenzene, 3-sulfonate-4-hydroxyazobenzene, 2,2'-dimethoxyazobenzene, 3,3'-dinitroazobenzene, 3,3'-dimethylazobenzene, 4,4'-dimethylazobenzene, 4,4'-dimethoxyazobenzene.

Specific examples of suitable chromenes include, but are not limited to, 3, 3-diphenyl-3H-naphtho[2,1-b]pyran; 2-methyl-7,7-diphenyl-7H-pyrano-[2,3-g]-benzothyazole; 2,2'-spiroadamantylidene-2H-naphtho-[1,2-b]pyran.

Specific examples of suitable photochromic bisimidazoles include, but are not limited to, 2,2',4,4',5,5'-hexaphenyl bisimidazole, 2,2',4,4',5,5'-hexa-p-tolyl bisimidazole, 2,2',4,4',5,5'-hexa-p-chlorophenyl bisimidazole, 2,2'-di-p-chlorophenyl-4,4',5,5'-tetraphenyl bisimidazole, 2,2'-di-p-anisyl-4,4',5,5'-tetraphenyl bisimidazole, and the like. Bisimidazole compounds are known, and can be prepared as described in, for example, Y. Sakaino, J. Chem. Soc.; Perkin Trans I, p. 1063 (1983), T. Hayashi et al., Bull. Chem. Soc. Japan, vol. 33, p. 565 (1960), T. Hayashi et al., J. Chem. Phys., vol. 32, p. 1568 (1960), T. Hayashi et al., Bull. Chem. Soc. Japan, vol. 38, p. 2202 (1965), and D. M. White et al., J. Org. Chem., vol. 29, p. 1926 (1964), the disclosures of each of which are totally incorporated herein by reference.

Non-limiting examples of suitable photochromic spirodihydroindolizines include 4,5-dicarbomethoxy-3H-pyrazole-(3-spiro-9)-fluorene; 1'H-2',3'-6 tricarbomethoxy-spiro (fluorine-9-1'-pyrrolo[1,2-b]-pyridazine]; 1'H-2',3'-dicyano-7-methoxy-carbonyl-spiro[fluorine-9,1'-pyrrolo-[1,2-b] pyridine, and the like.

Examples of photochromic quinones include, but are not limited to, 1-phenoxy-2,4-dioxyanthraquinone; 6-phenoxy-5,12-naphthacenequinone; 6-phenoxy-5,12-pentacenequinone; 1,3-dichloro-6-phenoxy-7,12-phthaloylpyrene, and the like.

Specific examples of photochromic perimidinespirocyclohexadienones include, but are not limited to, for example 2,3-dihydro-2-spiro-4'-(2',6'-di-tert-butylcyclohexadien-2',5'-one)-perimidine; 1-methyl-2,3-dihydro-2-spiro-4'-(2',6'-di-tert-butylcyclohexadien-2',5'-one)-perimidine; 2,3-dihydro-2-spiro-4'-[(4H)-2'-tert-butylnaphthalen-1'-one] perimidine; 5,7,9-trimethyl-2,3-dihydro-2-spiro-4'-(2',6'-di-tert-butylcyclohexadien-2',5'-one)-pyrido-[4,3,2,d,e] quinazoline.

Examples of suitable photochromic viologens include, but are not limited to, N,N'-dimethyl-4,4'-bipyridinium dichloride; N,N'-diethyl-4,4'-bipyridinium dibromide; N-phenyl, N'-methyl-4,4,-bipyridinium dichloride and the like.

Specific examples of suitable fulgides include, but are not limited to, 1-(p-methoxyphenyl)-ethylidene (isopropylidene) succinic anhydride; 2-[1-(2,5-dimethyl-3-furyl)-2-methylpropylidene]-3-isopropylidene succinic anhydride; (1,2-dimethyl-4-isopropyl-5-phenyl)-3-pyrryl ethylidene (isopropylidene) succinic an hydride, and the like.

A binder is optionally present. The role of the binder is that of a suspending medium to hold the photochromic material as a film or layer on the substrate of interest. The desired properties of the binder are any or all of the following: mechanical flexibility, robustness, and optical clarity. In embodiments, the binder should not be highly crystalline or light scattering so that the temporary images are of sufficient contrast. Moreover, in embodiments, the binder is a solid, nonvolatile material that will not be removed from the substrate.

Any suitable binder may be used such as a polymer material. Examples of polymer materials that can be used as binders include, but are not limited to, polycarbonates, polystyrenes, polysulfones, polyethersulfones, polyarylsulfones, polyarylethers, polyolefins, polyacrylates, polyvinyl derivatives, cellulose derivatives, polyurethanes, polyamides, polyimides, polyesters, silicone resins, and epoxy resins and the like. Copolymer materials such as polystyrene-acrylonitrile, polyethylene-acrylate, vinylidenechloride-vinylchloride, vinylacetate-vinylidene chloride, styrene-alkyd resins are also examples of suitable binder materials. The copolymers may be block, random, or alternating copolymers.

The protective layer includes a microencapsulated protective material. The protective material is a diarylethene material (DTE) of the general formula wherein $X_1$ and $X_2$=N or $X_1$=C—$R_2$ and $X_2$=C—$R_5$.

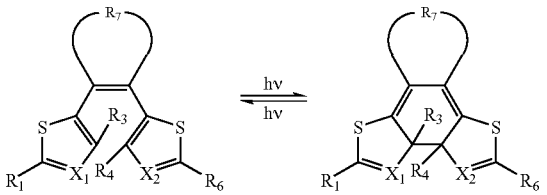

In this regard, X can be a Nitrogen atom (N), a CH group or a CR group. Compounds with X═C—H or C—R contain thiophene rings, and are known as diarylethenes (DTEs). Compounds with X═N are known as diarylethenes with thiazole groups, and are generally referred to as diarylethenes. The term diarylethenes can be used to describe both types of compounds where X═C—H or C—R or X═N. $R_1$, $R_2$, $R_3$, $R_4$, $R_5$, $R_6$, and $R_7$ each, independently of the others may be (but are not limited to) hydrogen; alkyl, including cyclic alkyl groups, such as cyclopropyl, cyclohexyl, and the like; unsaturated alkyl groups, such as vinyl ($H_2C$═CH—), allyl ($H_2C$═CH—$CH_2$—), propynyl (HC≡C—$CH_2$—), and the like, having from 1 to about 50 carbon atoms and, in some embodiments, from 1 to about 30 carbon atoms; aryl having, in embodiments, from about 6 to about 30 carbon atoms and, in other embodiments, from about 6 to about 20 carbon atoms; arylalkyl, having in embodiments from about 7 to about 50 carbon atoms and, in other embodiments, from about 7 to about 30 carbon atoms; silyl groups; nitro groups; cyano groups; halide atoms; such as fluoride, chloride, bromide, and iodide; amine groups, including primary, secondary, and tertiary amines; hydroxy groups, alkoxy groups having, in embodiments, from 1 to about 50 carbon atoms and, in other embodiments, from 1 to about 30 carbon atoms; aryloxy groups, having, in embodiments, from about 6 to about 30 carbon atoms and, in other embodiments, from about 6 to about 20 carbon atoms; alkylthio groups, having, in embodiments, from 1 to about 50 carbon atoms and, in other embodiments, from 1 to about 30 carbon atoms; arylthio groups, having, in embodiments, from about 6 to about 30 carbon atoms and, in other embodiments, from about 6 to about 20 carbon atoms; aldehyde groups; ketone groups; ester groups; amide groups; carboxylic acid groups; sulfonic acid groups; and the like. The alkyl, aryl, and arylalkyl groups can also be substituted with groups such as, for example, silyl groups; nitro groups; cyano groups; halide atoms, such as fluoride, chloride, bromide, and iodide; amine groups, including primary, secondary, and tertiary amines; hydroxy groups; alkoxy groups having, in embodiments, from 1 to about 20 carbon atoms and, in other embodiments, from 1 to about 10 carbon atoms; aryloxy groups, having, in embodiments, from about 6 to about 20 carbon atoms and, in embodiments, from about 6 to about 10 carbon atoms; alkylthio groups, having, in embodiments, from 1 to about 20 carbon atoms and, in other embodiments, from 1 to about 10 carbon atoms; arylthio groups, having, in embodiments, from about 6 to about 20 carbon atoms and, in other embodiments, from about 6 to about 10 carbon atoms; aldehyde groups; ketone groups; ester groups; amide groups; carboxylic acid groups; sulfonic acid groups, and the like. Further, two or more R groups (that is, $R_1$ through $R_6$) can be joined together to form a ring.

Moreover, the bridging group $R_7$ can be (but is not limited to)

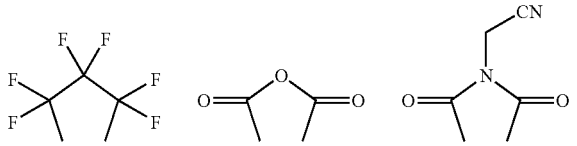

or $C_2H_4$ (ethyl), $C_3H_6$ (propyl), $C_4H_8$ (butyl), $C_2F_4$ (perfluoroethyl), $C_4F_8$ (perfluorobutyl).

Other examples of suitable protective materials include those of the generic formula

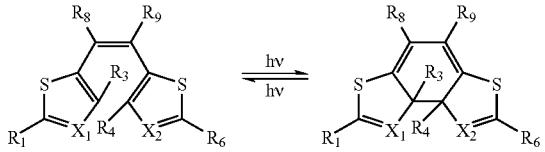

$X_1$ and $X_2$=N or $X_1$=C—$R_2$ and $X_2$=C—$R_5$; and wherein $R_1$, $R_2$, $R_3$, $R_4$, $R_5$, $R_6$, $R_8$ $R_9$ each, independently of the others can be (but are not limited to) hydrogen; alkyl, including cyclic alkyl groups, such as cyclopropyl, cyclohexyl, and the like; unsaturated alkyl groups, such as vinyl ($H_2C$=CH—), allyl ($H_2C$=CH—$CH_2$—), propynyl (HC≡C—$CH_2$—), and the like, having from 1 to about 50 carbon atoms and, in some embodiments, from 1 to about 30 carbon atoms; aryl having, in embodiments, from about 6 to about 30 carbon atoms and, in other embodiments, from about 6 to about 20 carbon atoms; arylalkyl, having in embodiments from about 7 to about 50 carbon atoms and, in other embodiments, from about 7 to about 30 carbon atoms; silyl groups; nitro groups; cyano groups; halide atoms; such as fluoride, chloride, bromide, and iodide; amine groups, including primary, secondary, and tertiary amines; hydroxy groups; alkoxy groups having, in embodiments, from 1 to about 50 carbon atoms and, in other embodiments, from 1 to about 30 carbon atoms; aryloxy groups, having, in embodiments, from about 6 to about 30 carbon atoms and, in other embodiments, from about 6 to about 20 carbon atoms; alkylthio groups, having, in embodiments, from 1 to about 50 carbon atoms and, in other embodiments, from 1 to about 30 carbon atoms; arylthio groups, having, in embodiments, from about 6 to about 30 carbon atoms and, in other embodiments, from about 6 to about 20 carbon atoms; aldehyde groups; ketone groups; ester groups; amide groups; carboxylic acid groups; sulfonic acid groups; and the like. The alkyl, aryl, and arylalkyl groups can also be substituted with groups such as, for example, silyl groups; nitro groups; cyano groups; halide atoms, such as fluoride, chloride, bromide, and iodide; amine groups, including primary, secondary, and tertiary amines; hydroxy groups; alkoxy groups having, in embodiments, from 1 to about 20 carbon atoms and, in other embodiments, from 1 to about 10 carbon atoms; aryloxy groups, having, in embodiments, from about 6 to about 20 carbon atoms and, in embodiments, from about 6 to about 10 carbon atoms; alkylthio groups, having, in embodiments, from 1 to about 20 carbon atoms and, in other embodiments, from 1 to about 10 carbon atoms; arylthio groups, having, in embodiments, from about 6 to about 20 carbon atoms and, in other embodiments, from about 6 to about 10 carbon atoms; aldehyde groups; ketone groups; ester groups; amide groups; carboxylic acid groups; sulfonic acid groups, and the like. Further, two or more R groups (that is, $R_1$ through $R_8$) can be joined together to form a ring.

X can be a Nitrogen atom (N), a CH group or a CR group. The ring structures containing N atoms are known as thiazoles. Compounds with X═N are known as diarylethenes with thiazole groups, or are generally referred to as diarylethenes. The term diarylethenes may also used to describe the previously mentioned diarylethenes (X═CH, or X═C—R).

The diarylethene materials suitable as the protective material are capable of switching between a UV absorbing state and a UV transparent state. The diarylethenes are switched from the UV absorbing state to a UV transparent state upon exposure to high intensity UV light of from about 250 to about 430 nm. Over time and/or upon exposure to wavelengths greater than 400 nm, the material switches back to its UV absorbing state. The diarylethenes are also photochromic protective materials in that, in addition to switching UV absorption properties, they also switch from a colorless (UV absorbing) state to a colored (UV transparent) state. The colored state of the diarylethenes generally exhibit a light yellow color.

In one embodiment, the diarylethene material is a material of the formula (DTE I).

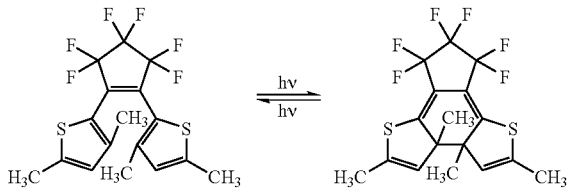

In another embodiment, the diarylethene material is a material of the formula (DTE II)

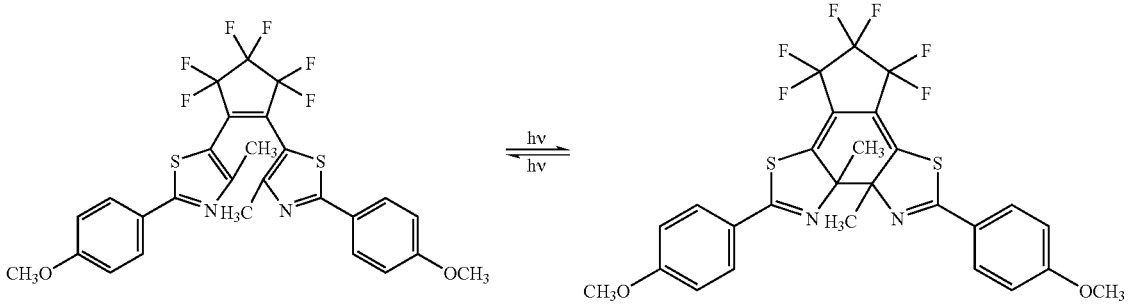

The diarylethenes switch from the UV absorbing to the UV transparent state in solution and not in film form. To provide the protective material in a switchable, solid medium form suitable for use on a reimageable medium, the diarylethene protective materials are microencapsulated. The diarylethene protective materials may be encapsulated by any suitable microencapsulation method. One example of a suitable microencapsulation method is complex coacervation. Complex coacervation is described in Kirk-Othmer, Encyclopedia of Chemical Technology, $4^{th}$ Ed. (1995), Vol. 16, pages 630–631. Complex coacervation may be accomplished by dispersing the material to be encapsulated in a warm gelatin solution to form an emulsion. Gum arabic and water are added to the emulsion and the pH is adjusted to between 4.0 and 4.5 to form a coacervate of gelatin, gum arabic, and water. Embryo microcapsules are then formed when the coacervate adsorbs on the surface of the material to be encapsulated and a liquid film surrounds the dispersed material to be encapsulated. The coacervate shell is gelled by cooling the system. The shell is cross-linked by adding glutaraldehyde or formaldehyde to the system. The capsules may then be coated over the display layer to form a protective film layer. Other suitable coacervation techniques include those described in U.S. Pat. Nos. 3,697,437; 4,808,408; 5,540,927; and 6,488,870, the entire disclosures of which are incorporated herein by reference.

The concentration of the diarylethene material in the microcapsules may be selected as desired for a particular purpose or intended use. The concentration may be selected to produce a desired level of protection to the underlying display layer. In embodiments, the diarylethene material is present in the microcapsules in an amount of from about 0.05 wt % to about 10 wt %, including from about 0.05 wt % to about 3.0 wt %.

The size of the microcapsules may also be selected as desired for a particular purpose or intended use. In embodiments, the microcapsules may have a size of from about 10 microns to about 500 microns, including from about 40 microns to about 125 microns. Of course, sizes outside of this range are also possible.

A reimageable recording medium is formed by providing a substrate, forming a display layer comprising a photochromic material over the substrate, and forming a protective layer comprising microencapsulated diarylethene materials over the display layer. Any suitable technique may be used to form the reimageable medium. For example, to deposit the display layer on the substrate, typical coating techniques include, but are not limited to, inkjet printing, premetered coating, such as patch die coating, slot or extrusion coating, slide or cascade coating, and curtain coating; roll coating; gravure coating; dip coating; spray coating; meniscus coating; spin coating; brush coating; screen printing processes; electrostatic printing processes; thermal printing processes, and other similar techniques. After deposition, solvent can be removed by drying for a time ranging for example from about 5 minutes to about 20 hours. Drying of the deposited coating can be effected by any suitable drying techniques or a combination of them. Suitable drying techniques include air drying, air impingement drying, oven drying, infra-red radiation drying and the like. The protective layer comprising the microencapsulated diarylethene material(s) is then coated over the display layer by any suitable technique including the above described coating technique.

In one embodiment an image may be formed on a reimageable recording medium by exposing selected areas of the recording medium to an imaging light of a first selected wavelength that is capable of switching the protective layer to a UV transparent state. The imaging light may have any suitable predetermined wavelength scope of a single wavelength or a band of wavelengths. In embodiments, the imaging light is an ultraviolet light having a single wavelength or a narrow band of wavelengths selected from the ultraviolet light wavelength range of from about 250 nm to about 430 nm. For each temporary image, the reimageable medium is exposed to the imaging light for a time period ranging from about 10 milliseconds to about 5 minutes, and, in some embodiments from about 30 milliseconds to about 1 minute. The imaging light may have an intensity ranging from, for example, about 0.1 $mW/cm^2$ to about 100 $mW/cm^2$, and in some embodiments, from about 0.5 $mW/cm^2$ to about 10 $mW/cm^2$. Upon exposure to the imaging light, the diarylethene protective material is converted from a UV absorbing state to a UV transparent state, such that the high intensity UV light is permitted to pass through the (exposed areas of the) protective layer to the underlying display layer. The imaging light then converts the photochromic material(s) of the display layer from a colorless state to a colored state to form a desired image. As used herein, the term "colorless state" refers to a state wherein the photochromic composition is invisible or there is an absence of contrast relative to the substrate. As used herein, the term "colored state" refers to a visible state as evidenced by a color contrast relative to the substrate or other imaged areas. The color contrast to render the temporary image visible to an observer can be a contrast between, for example, two, three, or more different colors. The term "color" encompasses a number of aspects such as, but not limited to, hue, lightness, and saturation where one color can be different from another color if the colors differ in at least one aspect. For example, two colors that have the same hue and saturation but are different in lightness would be considered different colors. Any suitable colors (e.g., red, black, blue, white, gray, yellow, orange, purple, and the like) may be used to produce the color contrast as long as the temporary image is visible to the naked eye. The term "color contrast" encompasses any degree of color contrast sufficient to render a temporary image discernable to an observer regardless of whether the color contrast changes or remains constant during the visible period.

In embodiments, the imaging light can be generated by, for example, a computer on a Light Emitting Diode (LED) array screen and the temporary image is formed on the reimageable medium by placing the medium on the LED screen for the preferred period of time. UV LED arrays of for example 396 nm are produced by EXFO (Mississauga, ON, Canada). Another suitable procedure for generating the imaging light corresponding to the predetermined image is the use of UV Raster Output Scanner (ROS).

In other embodiments, an image may be formed by i) exposing selected areas of the medium to a light of a first wavelength that is suitable for switching the protective layer to a UV transparent state, and ii) then exposing the selected areas to an imaging light of a second wavelength to convert the photochromic material from a colorless state to a colored state to render a visible image. In embodiments, the imaging light of the second wavelength is an ultraviolet light having a wavelength or a narrow band of wavelengths selected from the ultraviolet light wavelength range of from about 250 nm to about 430 nm. In embodiments, the first and second wavelengths can be the same or different wavelengths.

The protective material of the protective layer is then switched back to the UV absorbing state upon exposure to wavelengths greater than 400 nm. The protective layer may be switched to the UV absorbing state by exposing the medium to a light source or to ambient viewing conditions to render the protective layer UV absorbing. The protective layer prevents unimaged areas of the document from being exposed to incident UV light from the reading light (e.g., UV-VIS, room-light, or sun-light) and prevents the unimaged areas of the display layer from changing from a colorless to a colored state, which would reduce the resolution and contrast of the document.

The image may be viewed under ambient reading/viewing condition including darkness at ambient temperature, indoor ambient light at ambient temperature, or both the darkness at ambient temperature and the indoor ambient light at ambient temperature. "Ambient temperature" refers to temperatures ranging from about 15 to about 30 degrees C. The indoor ambient light includes, for example, the typical office lighting where the indoor ambient light may be entirely artificial light (e.g., light from an incandescent bulb and/or fluorescent bulb), or entirely sunlight coming in through a glass window, or a mixture of artificial light and sunlight coming through a glass window and the like. Where the indoor ambient condition includes darkness at ambient temperature, the term "darkness" refers to a low light level where the office lighting is turned off and where there is insignificant amount of sunlight entering the room (e.g., there is no window or the sun has set or the window drapes/blinds are closed). The term "darkness" also encompasses the nighttime situation where the office lighting is turned off, but there are "city lights" streaming into the room through the window. In embodiments of the present method, the reimageable medium with the temporary image is exposed to the indoor ambient condition for an image erasing time ranging for example from about 1 hour to about 5 days, or from about 3 hours to about 24 hours. In embodiments, since the temporary image typically remains under an indoor ambient condition during the entire visible time, the image erasing time includes the visible time. The visible time for the temporary image ranges for example from about 1 hour to about 5 days, or from about 3 hours to about 24 hours. In embodiments, fading of the temporary image (due to a decrease in the color contrast) may be noticeable within the visible time described herein, but the visible time indicates the time period when the temporary image is discernable to the naked eye. For example, if the temporary image is visible for 5 hours, then the image erasing time could be any value of 5 plus hours. In embodiments, the image erasing time exceeds the visible time by a time period of for example at least 30 minutes, or from about 1 hour to about 24 hours.

The image is erased over time as the photochromic material of the display layer is converted back to its colorless state. In embodiments of the present method and of the present reimageable medium, erasure of the temporary image can occur by any of the following: (i) changing the color of the exposed region (that is, exposed to the imaging light) to the color of the non-exposed region (that is, not exposed to the imaging light); (ii) changing the color of the non-exposed region to the color of the exposed region; or (iii) changing the color of the exposed region and of the color of the non-exposed region to the same color different from both the exposed region color and the non-exposed region color. After the image is erased, the recording medium comprising a microencapsulated diarylethene protective material is ready to be reimaged.

Over time, the protecting layer may absorb some of the incident UV light from the reading light sources such that the protective material is converted to the colored form. Diarylethenes have a relatively pale yellow colored state. Thus, even if unimaged areas of the substrate are converted to the colored state, there is still generally a sufficient contrast between the imaged areas and the unimaged areas to provide a readable document.

A reimageable recording medium comprising a protective layer comprising microencapsulated diarylethene materials is further described with reference to the following examples. The examples are merely illustrative embodiments of a recording medium in accordance with the present disclosure and not intended to be limiting in any manner.

EXAMPLES

Synthesis of DTE I

A diarylethene of the formula DTE I was prepared as follows. In a 250 mL Schlenk tube was added 2.29 g (13.14 mmol) of 4-phenyl-2-methyl thiophene, followed by purging with argon. Next, 30 mL of dry THF was added, and the mixture was stirred until the solid was completely dissolved. The reaction was cooled to 0° C., and 6 mL of 2.41 M n-butyllithium was added (14.45 mmol, 1.1 eq). The reaction was heated to 75–80° C. for 90 min. The reaction was again cooled to 0° C., and 0.88 mL (6.57 mmol, 0.5 eq) of perfluorocyclopentene was added. The reaction was allowed to gradually warm to room temperature, and stirred overnight. The product was isolated via flash chromatography using 100% hexanes as eluent to yield 1.26 g of yellow solid in 37% yield.

Synthesis of DTE II

A diarylethene of the formula DTE II was prepared as follows. In a 250 mL Schlenk tube was added 0.5 g (1.76 mmol) of 5-bromo-2-(p-methoxyphenyl)-4-methylthiazole, followed by purging with argon. Next, 40 mL of dry THF was added, and the mixture was stirred until the bromide was completely dissolved. The reaction was cooled to −60° C., and 0.94 mL of 2.35M n-butyllithium was added (2.20 mmol, 1.25 eq). The reaction was stirred for 1 h at −60° C., and 118 uL (0.88 mmol, 0.5 eq) of perfluorocyclopentene was added. The reaction was maintained at −60° C. for 2 hours, and allowed to warm to room temperature, and stirred overnight. The product was isolated by column chromatography, using 1:4 EtOAc:hexanes to yield 85 mg of yellow solid in 17% yield.

Microencapsulation of DTE II in Isopar M

A solution of diarylethene DTE II in Isopar M was encapsulated using the technique of complex coacervation, under high shear, provided with an overhead mixer equipped with a 3-blade impeller. 30 mg of DTE II is dissolved in 60 mL of Isopar M for a DTE concentration of 0.05%. The encapsulation solution was prepared by mixing the following solutions (heated to 40° C.): 100 mL of a 6.6% gelatin solution, 400 mL of water, and 100 mL of a 6.6% solution of gum Arabic solution in warm water. Next, the pH of the encapsulation solution was adjusted to 4.5 via dropwise addition of dilute acetic acid solution. The DTE II solution was poured into the encapsulation bath, and allowed to cool to room temperature. The resultant capsules were crosslinked with gluteraldehyde, washed with water, and wet-sieved to isolate the desired capsule size.

Preparation of DTE II Capsule Test Films

One (1) g of wet capsule slurry was mixed with 0.5 g of warm gelatin solution. The mixture was spread onto a plastic sheet at 40° C., allowed to cool to room temperature, and air-dried overnight. After 24 hours, the dried film was peeled off of the plastic sheet and characterized via UVNIS spectroscopy.

Irradiation of Test Films

An EXFO 400 nm UV light source was used for sample irradiation. For erasure, a visible light source with a 400 nm light filter was used. The absorbance band of the DTE-2 film centered at 373 nm was reduced from 0.891 to 0.666 after two (2) minutes of UV irradiation. Erasure of the film gave an absorbance increase of the 373 nm band to 0.923.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A reimageable medium comprising:

a substrate;

a display layer comprising a photochromic material that is imageable upon exposure to an imaging light of a first wavelength; and a protective layer comprising a microencapsulated protective material that is switchable between a UV light absorbing state and a UV light transparent state.

2. The reimageable recording medium according to claim 1, wherein the protective material is switchable from a UV absorbing state to a UV transparent state at the first wavelength.

3. The reimageable recording medium according to claim 1, wherein the first wavelength is ranging from about 250 nm to about 430 nm.

4. The reimageable recording medium according to claim 1, wherein the protective material is switchable from a UV absorbing state to a UV transparent state at a wavelength of about 400 nm.

5. The reimageable recording medium according to claim 1, wherein the protective material is a diarylethene of the formula

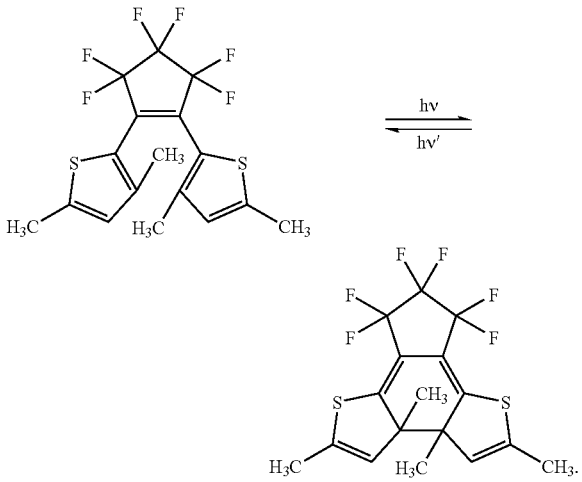

6. The reimageable recording medium according to claim 1, wherein the protective material is a diarylethene of the formula

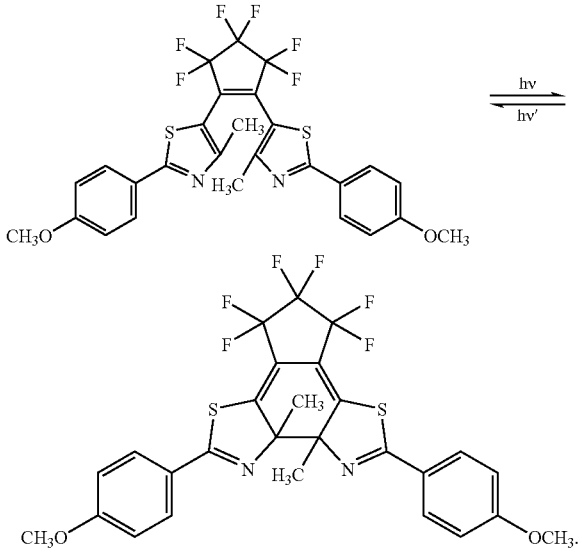

7. A reimageable recording medium comprising:

a substrate;

a display layer comprising a photochromic material that is imageable upon exposure to an imaging light of a first wavelength; and a protective layer comprising a plurality of microcapsules comprising a diarylethene material, the diarylethene material being switchable between a UV absorbing state and a UV transparent state.

8. The reimageable recording medium according to claim 7, wherein the diarylethene material is transparent to UV light at a wavelength of from about 250 to about 430 nm.

9. The reimageable recording medium according to claim 7, wherein the diarylethene material is transparent to UV light at a wavelength of about 400 nm.

10. The reimageable recording medium according to claim 7, wherein the diarylethene material is

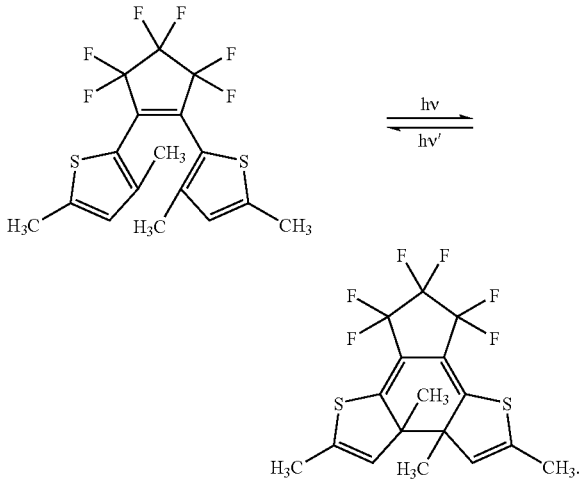

11. The reimageable recording medium according to claim 7, wherein the diarylethene material is

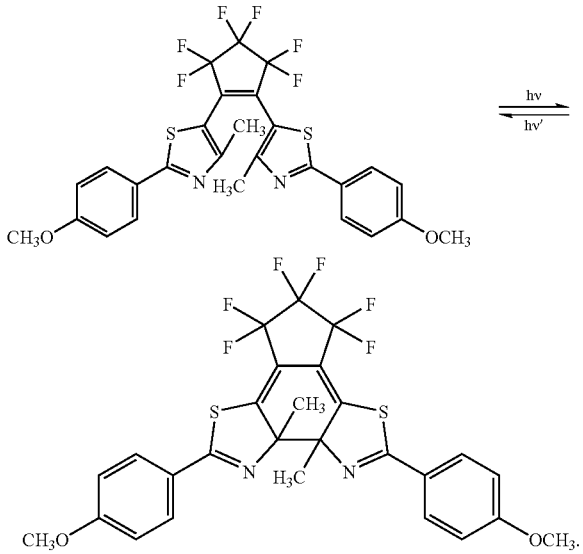

12. The reimageable recording medium according to claim 7, wherein the microcapsules have a size of from about 10 to about 500 microns.

13. The reimageable recording medium according to claim 7, wherein the diarylethene material absorbs UV light at wavelengths of light greater than 400 nm.

14. A method for forming a temporary image comprising:

a) providing a reimageable medium comprising a substrate, a display layer comprising a photochromic material, and a protective layer, the protective layer comprising a plurality of microcapsules encapsulating a diarylethene material that is switchable between a UV light absorbing state and a UV light transparent state;

b) exposing selected areas of the medium to light of a first wavelength sufficient for switching the protective layer from a UV light absorbing state to a UV light transparent state;

c) exposing the selected areas of the medium to light of a second wavelength to convert the photochromic material from a colorless state to a colored state, thereby forming a viewable image; and d) exposing the medium to light of a third wavelength sufficient to switch the protective layer from a UV transparent state to a UV absorbent state.

15. The method according to claim 14, wherein the first wavelength is from about 250 to about 430 nm.

16. The method according to claim 14, wherein the second wavelength is from about 250 to about 430 nm.

17. The method according to claim 14, wherein the third wavelength is 400 nm or greater.

18. The method according to claim 14, wherein the first wavelength and the second wavelength are in the range of from about 365 to about 400 nm.

19. The method according to claim 14, wherein the protective layer is switched from a UV transparent state to a UV transparent, and the photochromic material is converted from a colorless state to a colored state upon exposure to the light of the first wavelength.

20. The reimageable recording medium according to claim 14, wherein the diarylethene material is a diarylethene of the formula

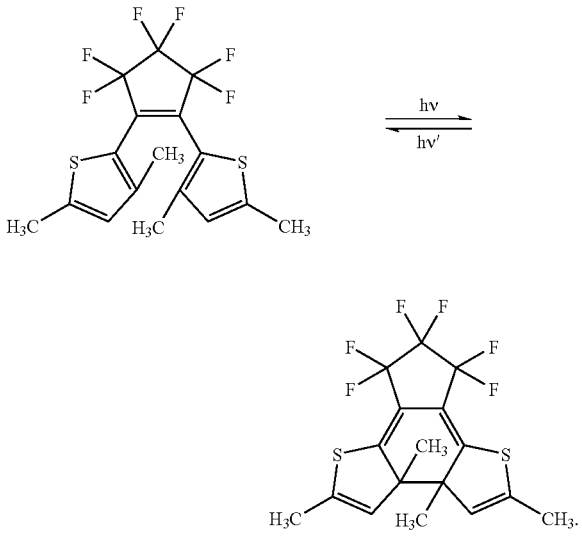

21. The reimageable recording medium according to claim 14, wherein the diarylethene material is a diarylethene of the formula

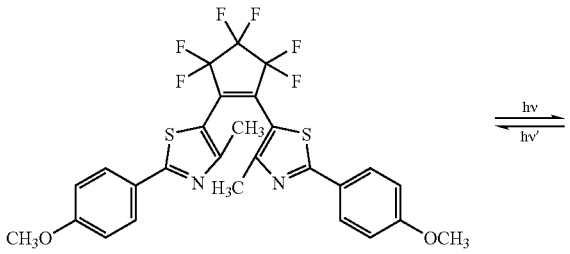

-continued

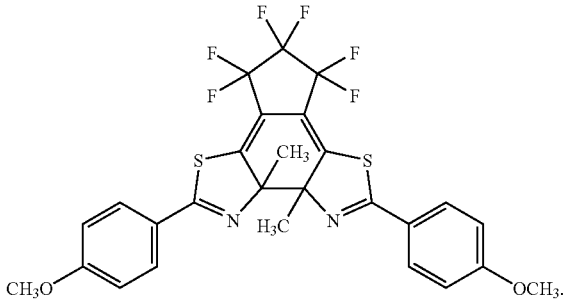

22. The reimageable recording medium according to claim 14, wherein the microcapsules have a size of from about 10 microns to about 500 microns.

23. The reimageable recording medium according to claim 14, further comprising e) erasing the temporary image by exposing the temporary image to a reading light for a period of time sufficient to convert the photochromic material back to a colorless state.

24. The reimageable recording medium according to claim 23, further comprising f) repeating procedures (b)–(e) one or more times to result in the medium undergoing a number of additional imaging cycles.

25. The reimageable recording medium according to claim 1, wherein the protective material is a diarylethene of the formula

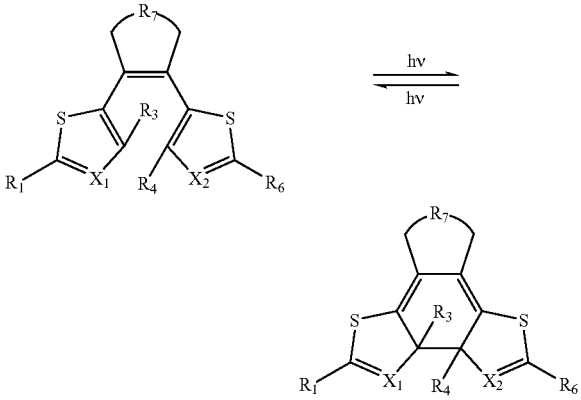

wherein $X_1$ and $X_2$=N or $X_1$=C—$R_2$ and $X_2$=C—$R_5$;

wherein $R_1$, $R_2$, $R_3$, $R_4$, $R_5$, and $R_6$ are independently selected from hydrogen, alkyl, cyclic alkyl, unsaturated alkyl, aryl, arylalkyl, silyl, nitro, cyano, halide, amine, hydroxyl, alkoxy, aryloxy, alkylthio, arylthio, aldehyde, ketone, ester, amide, carboxylic acid, and sulfonic acid;

wherein two or more of $R_1$, $R_2$, $R_3$, $R_4$, $R_5$, and $R_6$ may be joined together to form a ring; and wherein $R_7$ is selected from alkyl, cyclic alkyl, unsaturated alkyl, aryl, arylalkyl, silyl, amine, alkoxy, aryloxy, alkylthio, arylthio, ketone, ester, amide,

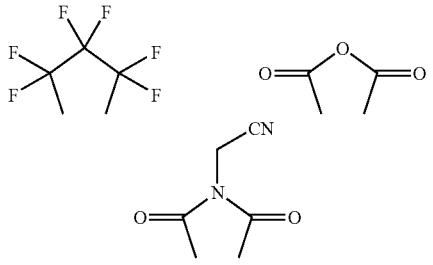

$C_2H_4$, $C_3H_6$, $C_4H_8$, $C_2F_4$, and $C_4F_8$.

26. The reimageable recording medium according to claim 1, wherein the protective material is a diarylethene of the formula

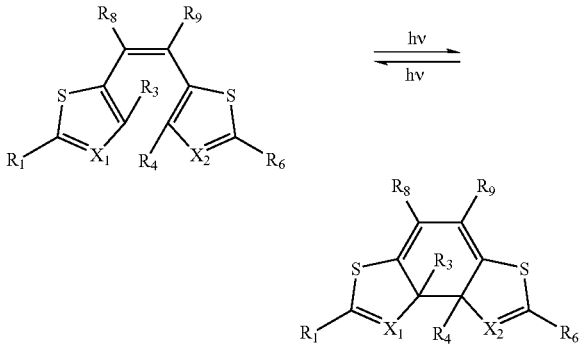

wherein $X_1$ and $X_2$=N or $X_1$=C—$R_2$ and $X_2$=C—$R_5$; and wherein $R_1$, $R_2$, $R_3$, $R_4$, $R_5$, $R_6$, $R_8$, and $R_9$ are independently selected from hydrogen, alkyl, cyclic alkyl, unsaturated alkyl, aryl, arylalkyl, silyl, nitro, cyano, halide, amine, hydroxyl, alkoxy, aryloxy, alkylthio, arylthio, aldehyde, ketone, ester, amide, carboxylic acid, and sulfonic acid.

27. The reimageable recording medium according to claim 7, wherein the protective material is a diarylethene of the formula

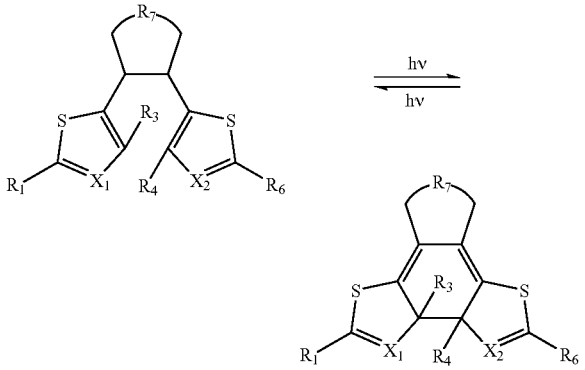

wherein $X_1$ and $X_2$=N or $X_1$=C—$R_2$ and $X_2$=C—$R_5$;

wherein $R_1$, $R_2$, $R_3$, $R_4$, $R_5$, and $R_6$ are independently selected from hydrogen, alkyl, cyclic alkyl, unsaturated alkyl, aryl, arylalkyl, silyl, nitro, cyano, halide, amine, hydroxyl, alkoxy, aryloxy, alkylthio, arylthio, aldehyde, ketone, ester, amide, carboxylic acid, and sulfonic acid;

wherein two or more of $R_1$, $R_2$, $R_3$, $R_4$, $R_5$, and $R_6$ may be joined together to form a ring; and wherein $R_7$ is selected from alkyl, cyclic alkyl, unsaturated alkyl, aryl, arylalkyl, silyl, amine, alkoxy, aryloxy, alkylthio, arylthio, ketone, ester, amide,

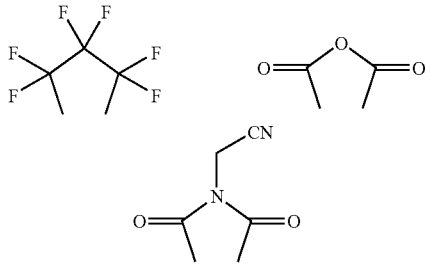

$C_2H_4$, $C_3H_6$, $C_4H_8$, $C_2F_4$, and $C_4F_8$.

28. The reimageable recording medium according to claim 7, wherein the protective material is a diarylethene of the formula

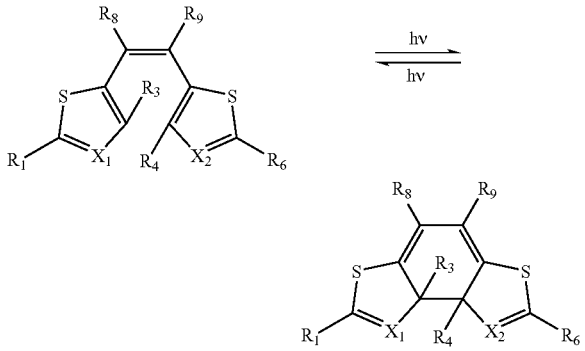

wherein $X_1$ and $X_2$=N or $X_1$=C—$R_2$ and $X_2$=C—$R_5$; and wherein $R_1$, $R_2$, $R_3$, $R_4$, $R_5$, $R_6$, $R_8$, and $R_9$ are independently selected from hydrogen, alkyl, cyclic alkyl, unsaturated alkyl, aryl, arylalkyl, silyl, nitro, cyano, halide, amine, hydroxyl, alkoxy, aryloxy, alkylthio, arylthio, aldehyde, ketone, ester, amide, carboxylic acid, and sulfonic acid.

29. The reimageable recording medium according to claim 14, wherein the protective material is a diarylethene of the formula

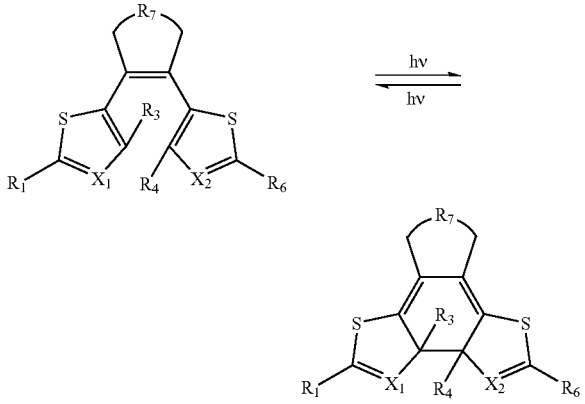

wherein $X_1$ and $X_2$=N or $X_1$=C—$R_2$ and $X_2$=C—$R_5$;

wherein $R_1$, $R_2$, $R_3$, $R_4$, $R_5$, and $R_6$ are independently selected from hydrogen, alkyl, cyclic alkyl, unsaturated alkyl, aryl, arylalkyl, silyl, nitro, cyano, halide, amine, hydroxyl, alkoxy, aryloxy, alkylthio, arylthio, aldehyde, ketone, ester, amide, carboxylic acid, and sulfonic acid;

wherein two or more of $R_1$, $R_2$, $R_3$, $R_4$, $R_5$, and $R_6$ may be joined together to form a ring; and wherein $R_7$ is selected from alkyl, cyclic alkyl, unsaturated alkyl, aryl, arylalkyl, silyl, amine, alkoxy, aryloxy, alkylthio, arylthio, ketone, ester, amide,

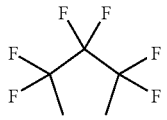

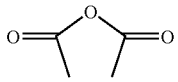

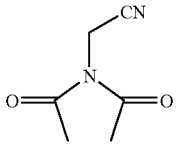

$C_2H_4$, $C_3H_6$, $C_4H_8$, $C_2F_4$, and $C_4F_8$.

30. The reimageable recording medium according to claim 14, wherein the protective material is a diarylethene of the formula

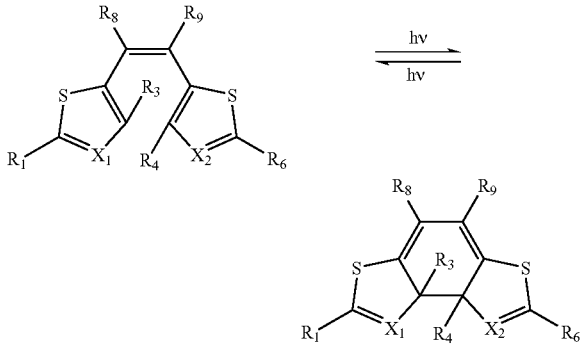

wherein $X_1$ and $X_2$=N or $X_1$=C—$R_2$ and $X_2$C—$R_5$; and wherein $R_1$, $R_2$, $R_3$, $R_4$, $R_5$, $R_6$, $R_8$, and $R_9$ are independently selected from hydrogen, alkyl, cyclic alkyl, unsaturated alkyl, aryl, arylalkyl, silyl, nitro, cyano, halide, amine, hydroxyl, alkoxy, aryloxy, alkylthio, arylthio, aldehyde, ketone, ester, amide, carboxylic acid, and sulfonic acid.

* * * * *